US008967984B2

(12) United States Patent
Lee et al.

(10) Patent No.: US 8,967,984 B2
(45) Date of Patent: Mar. 3, 2015

(54) ROTARY COMPRESSOR

(75) Inventors: Yunhi Lee, Seoul (KR); Seungjun Lee, Seoul (KR); Minchul Yong, Seoul (KR)

(73) Assignee: LG Electronics Inc., Seoul (KR)

( * ) Notice: Subject to any disclaimer, the term of this patent is extended or adjusted under 35 U.S.C. 154(b) by 652 days.

(21) Appl. No.: 12/972,608

(22) Filed: Dec. 20, 2010

(65) Prior Publication Data

US 2011/0150683 A1 Jun. 23, 2011

(30) Foreign Application Priority Data

Dec. 22, 2009 (KR) ..... 10-2009-0129188

(51) Int. Cl.

| | |
|---|---|
| ***F04C 18/344*** | (2006.01) |
| ***F04C 18/356*** | (2006.01) |
| ***F04C 18/08*** | (2006.01) |
| ***F04C 23/00*** | (2006.01) |
| ***F04C 28/02*** | (2006.01) |
| ***F04C 29/12*** | (2006.01) |

(52) U.S. Cl.

CPC ..... *F04C 18/356* (2013.01); *F04C 18/086* (2013.01); *F04C 23/001* (2013.01); *F04C 23/008* (2013.01); *F04C 28/02* (2013.01); *F04C 29/12* (2013.01); *F04C 2240/80* (2013.01)

USPC ..... 418/5; 418/7; 418/11; 418/248; 418/249; 418/251

(58) Field of Classification Search

CPC ..... F04C 18/356; F04C 18/086; F04C 28/02; F04C 23/001; F04C 23/008; F04C 29/12; F04C 2240/80

USPC ..... 418/5, 7, 11, 248, 249, 251

See application file for complete search history.

(56) References Cited

U.S. PATENT DOCUMENTS

| | | | | |
|---|---|---|---|---|
| 4,340,339 | A * | 7/1982 | Hiraga et al. | 418/55.6 |
| 5,152,156 | A * | 10/1992 | Tokairin | 62/498 |
| 2007/0140881 | A1* | 6/2007 | Matsumoto et al. | 418/9 |
| 2008/0240954 | A1* | 10/2008 | Morozumi et al. | 418/13 |
| 2010/0111737 | A1* | 5/2010 | Higashi et al. | 418/11 |
| 2010/0147020 | A1* | 6/2010 | Hirayama | 62/498 |

(Continued)

FOREIGN PATENT DOCUMENTS

| | | | |
|---|---|---|---|
| CN | 1423056 | A | 6/2003 |
| CN | 1280592 | A | 10/2006 |
| CN | 101128673 | A | 2/2008 |

(Continued)

OTHER PUBLICATIONS

JP02009085027A_English_Translation.*

(Continued)

*Primary Examiner* — Thai Ba Trieu
*Assistant Examiner* — Jason T Newton
(74) *Attorney, Agent, or Firm* — Ked & Associates, LLP

(57) ABSTRACT

A twin rotary compressor is provided. In the twin rotary compressor, a refrigerant suction pipe may be connected to a middle plate positioned between a first cylinder and a second cylinder to reduce a height of the first cylinder, so that heights of a first rolling piston and a first vane may also be lowered. This may allow a contact area between the first rolling piston and the first vane to be decreased so as to reduce refrigerant leakage from a first compression space of the first cylinder, resulting in improvement of compression efficiency of the compressor.

17 Claims, 5 Drawing Sheets

(56) References Cited

U.S. PATENT DOCUMENTS

| | | | | |
|---|---|---|---|---|
| 2011/0023535 | A1* | 2/2011 | Morimoto et al. | 62/510 |
| 2012/0260691 | A1* | 10/2012 | Hirayama | 62/498 |

FOREIGN PATENT DOCUMENTS

| | | | | | |
|---|---|---|---|---|---|
| CN | 101275562 | A | | 10/2008 | |
| EP | 1 850 009 | A2 | | 10/2007 | |
| EP | 1 975 413 | A1 | | 10/2008 | |
| EP | 1 975 414 | A2 | | 10/2008 | |
| JP | 10213087 | A | * | 8/1998 | F04C 29/06 |
| JP | 2003-161278 | | | 6/2003 | |
| JP | 2008128069 | A | * | 6/2008 | F04C 23/00 |
| JP | 2009085027 | A | * | 4/2009 | F04C 29/12 |
| WO | WO 03/054391 | A1 | | 7/2003 | |
| WO | WO 2006046784 | A1 | * | 5/2006 | F04C 29/02 |
| WO | WO 2006/064985 | A1 | | 6/2006 | |
| WO | WO 2009/031626 | A1 | | 3/2009 | |
| WO | WO 2009061038 | A1 | * | 5/2009 | F04C 18/356 |

OTHER PUBLICATIONS

JP02008128069A_English_Translation.*
JP 10213087 A Description_English_Translation.*
Chinese Office Action issued in CN Application No. 201010601546.4 dated Mar. 11, 2013.
European Search Report dated Oct. 21, 2011.
Chinese Office Action dated Apr. 22, 2014, issued in Application No. 201010602546.4 (with English translation).

* cited by examiner

ROTARY COMPRESSOR

CROSS-REFERENCE TO RELATED APPLICATION(S)

This application claims priority under 35 U.S.C. §119 to Korean Application No. 10-2009-0129188, filed in Korea on Dec. 22, 2009, whose entire disclosure is hereby incorporated by reference.

BACKGROUND

1. Field

This relates to a rotary compressor, and in particular, to a twin rotary compressor having a plurality of compression spaces.

2. Background

In general, refrigerant compressors are used in refrigerators or air conditioners using a vapor compression refrigeration cycle (hereinafter, referred to as 'refrigeration cycle'). A constant speed type compressor may be driven at a substantially constant speed, while an inverter type compressor may be operated at selectively controlled rotational speeds.

A refrigerant compressor, in which a driving motor and a compression device operated by the driving motor are installed in an inner space of a hermetic casing, is called a hermetic compressor, and may be used in various home and/or commercial applications. A refrigerant compressor, in which the driving motor is separately installed outside the casing, is called an open compressor. Refrigerant compressors may be further classified into a reciprocal type, a scroll type, a rotary type and others based on a mechanism employed for compressing a refrigerant.

The rotary compressor may employ a rolling piston which is eccentrically rotated in a compression space of a cylinder, and a vane, which partitions the compression space of the cylinder into a suction chamber and a discharge chamber. Such a compressor may benefit from an enhanced capacity or a variable capacity.

BRIEF DESCRIPTION OF THE DRAWINGS

The embodiments will be described in detail with reference to the following drawings in which like reference numerals refer to like elements wherein.

DETAILED DESCRIPTION

A twin rotary compressor may include a plurality of cylinders that may be selectively operated to provide increased and/or variable capacity. Such a twin rotary compressor may be further classified into a capacity-variable type compressor in which a plurality of cylinders may be operated independent of each other to independently compress refrigerant, and a two-stage type in which a plurality of cylinders communicate with each other to sequentially compress refrigerant. Such a twin rotary compressor may have upper and lower cylinders, which may have the same capacity or different capacities. For example, if both cylinders have the same inner diameter and the same capacity, the upper and lower cylinders may have the same height. If both cylinders have the same inner diameter and different capacities, the upper and lower cylinders may have different heights.

In such a two-stage type rotary compressor, a refrigerant suction pipe is typically connected to the lower cylinder, and so a height of the lower cylinder may be greater than that of the upper cylinder to accommodate the connection of the suction pipe thereto. That is, if the refrigerant suction pipe is connected to the lower cylinder, the height of the lower cylinder may be greater than at least an outer diameter of the refrigerant suction pipe. In order for the cylinder to have sufficient rigidity to preclude deformation thereof upon insertion of the refrigerant suction pipe, the cylinder may have a predetermined thickness in the vicinity of an inlet through which the refrigerant suction pipe is received. Therefore, the overall height of the lower cylinder may be at least as much as a value obtained by adding the outer diameter of the refrigerant suction pipe and additional thicknesses thereof at both upper and lower ends of the refrigerant suction pipe to ensure sufficient strength. However, as the height of the lower cylinder is greater, a contact area between a rolling piston and a vane in the lower cylinder may be increased, thus increasing refrigerant leakage between the rolling piston and the vane and losses in compression efficiency and capacity.

Figure 1:
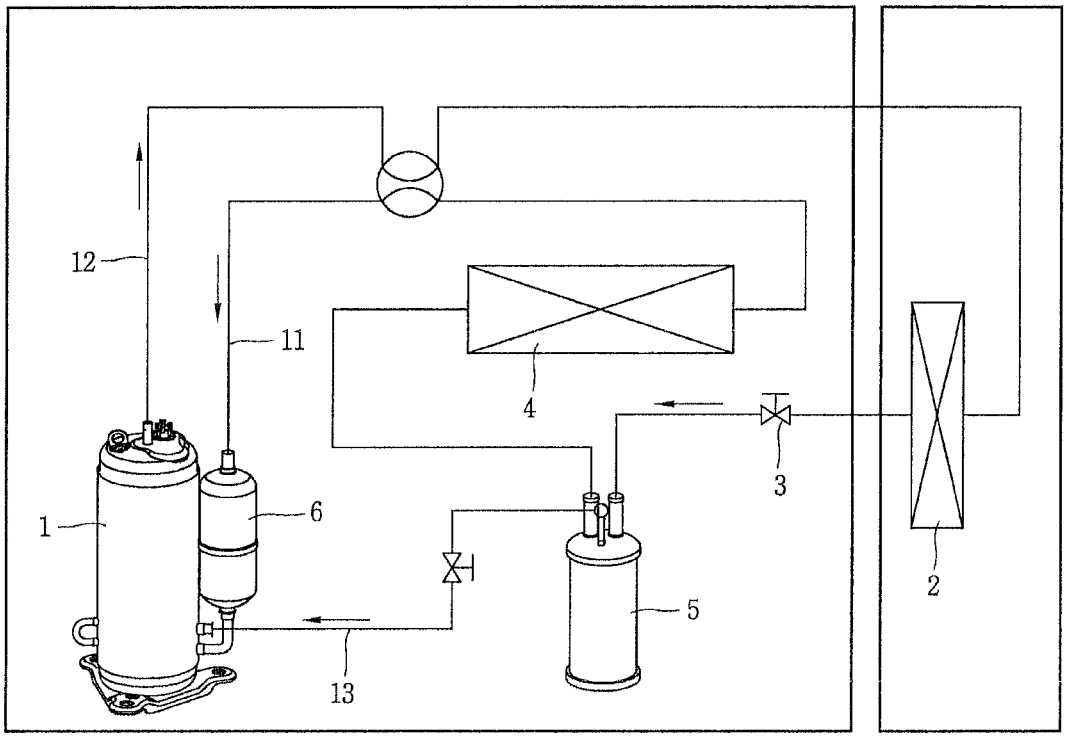
FIG. 1 is a schematic view of a refrigeration cycle including a two-stage type rotary compressor in accordance with an embodiment as broadly described herein.

As shown in FIG. 1, a refrigeration cycle may include a compressor 1, a condenser 2, an expansion valve 3, an evaporator 4 and a phase separator 5. Refrigerant compressed in the compressor 1 may be introduced into the condenser 2, where it is heat-exchanged with ambient air and condensed. The condensed refrigerant may pass through the expansion valve 3 and is then divided into gas refrigerant and liquid refrigerant by the phase separator 5. The liquid refrigerant is then introduced into the evaporator 4 and evaporated through heat-exchange, and introduced into an accumulator 6 in a gas state. This refrigerant then flows from the accumulator 6 into a first compression device of the compressor 1 via a refrigerant suction pipe 11.

The gas refrigerant divided by the phase separator 5 may be introduced into the compressor 1 via an injection pipe 13. An intermediate pressure refrigerant compressed in the first compression device of the compressor 1 and refrigerant introduced via the injection pipe 13 may then flow into a second compression device of the compressor 1 to be compressed into a high pressure refrigerant, thereby being discharged into the condenser 2 via a refrigerant discharge pipe 12.

Figure 2:
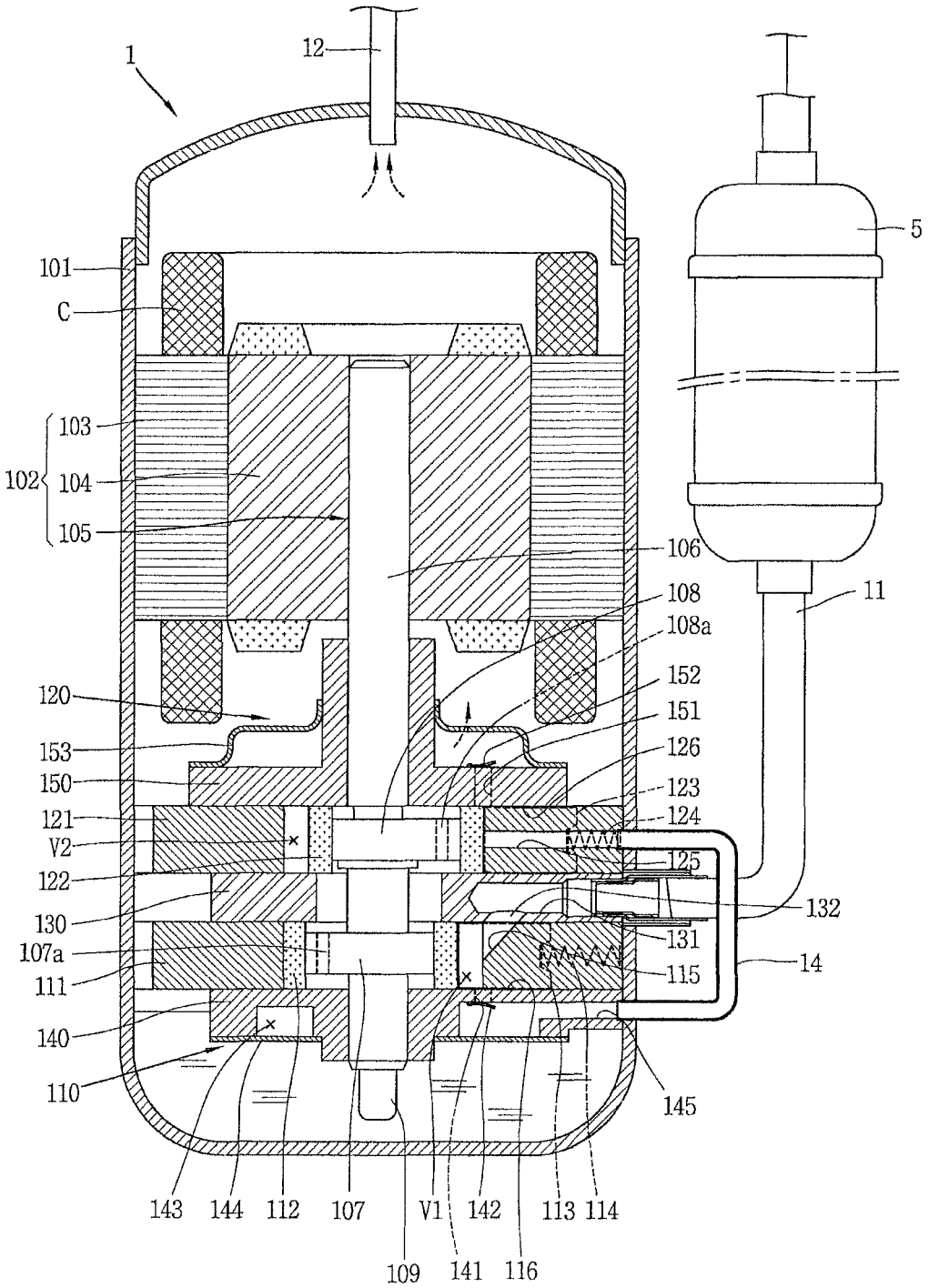
FIGS. 2 and 3 are longitudinal views showing of the two-stage type rotary compressor shown in FIG. 1.
Figure 3:
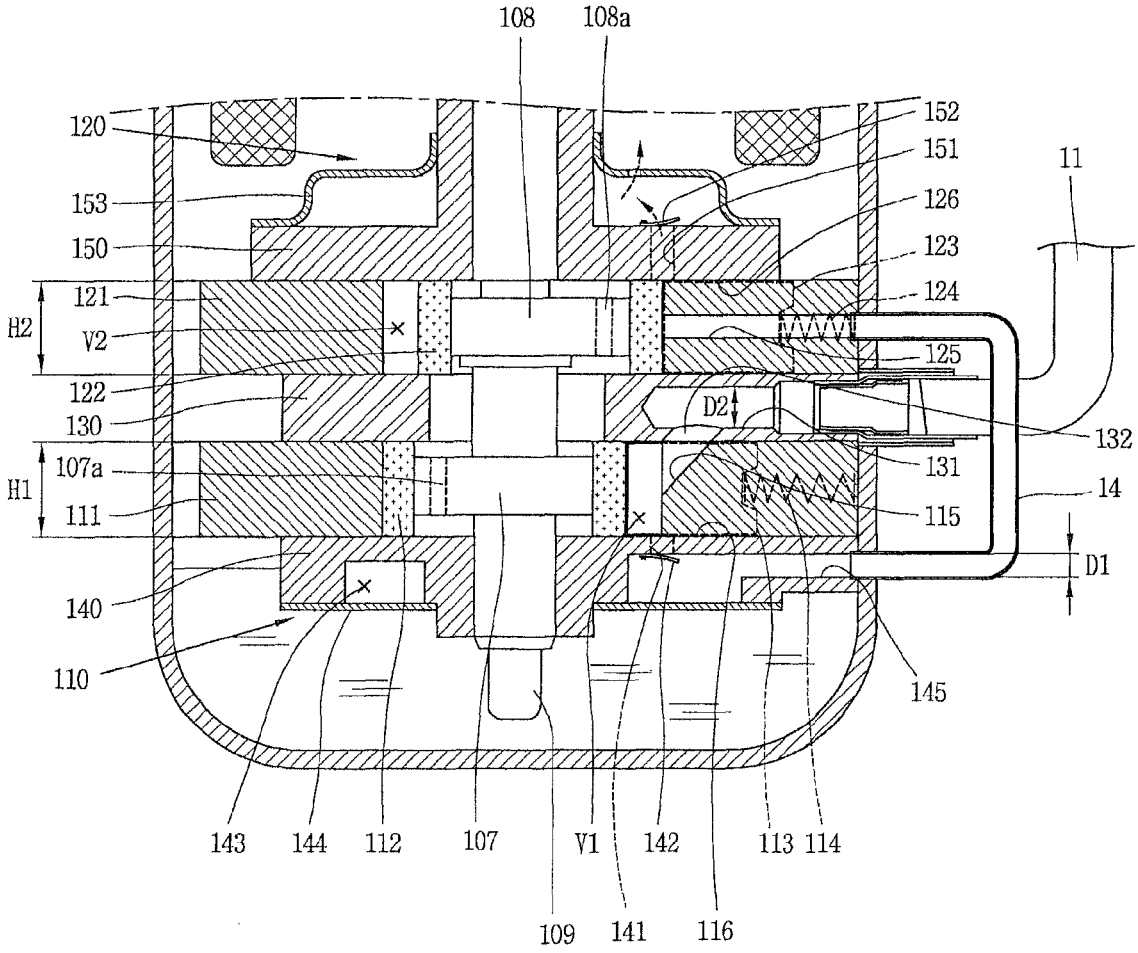

As shown in FIGS. 2 and 3, in a configuration of the two-stage type rotary compressor 1 according to the one exemplary embodiment, a driving motor 102 may be installed in an inner space of the hermetic casing 101 to generate a driving force, and a first compression device 110 and a second compression device 120 may be positioned below the driving motor 102, with a middle plate 130 positioned therebetween such that the first compression device 110 may define a low pressure side and the second compression device 120 may define a high pressure side. The refrigerant suction pipe 11 may be installed at and inserted into the hermetic casing 101, and connected to an inlet of the first compression device 110 via the middle plate 130. The refrigerant discharge pipe 12 may be installed at a top of the hermetic casing 101, and may be connected to the inner space of the hermetic casing 101 so as to discharge a refrigerant into the condenser 2.

The driving motor 102 may include a stator 103 secured to an inner circumferential surface of the hermetic casing 101, a rotor 104 rotatably installed in the stator 103, and a crankshaft 105 coupled to the center of the rotor 104 so as to transfer a rotating force to each of the compression device 110 and 120. In certain embodiments, the stator 103 may be formed by laminating a plurality of annular steel plates and winding a coil C on the laminated steel plates. In certain embodiments, the rotor 104 may be formed by laminating a plurality of annular steel plates.

The crankshaft 105 may include a shaft portion 106 having a bar-like shape with a predetermined length, and being integrally fixed through a center of the rotor 104, and first and second eccentric portions 107 and 108 that protrude eccentrically from a lower part of the shaft portion 106 in a radial direction so as to be rotatably coupled to first and second rolling pistons 112 and 122, respectively.

An oil passage may extend from a lower to an upper end of the shaft portion 106, and an oil feeder 109 may be coupled to a lower end of the oil passage.

The first eccentric portion 107 and the second eccentric portion 108 may be formed such that a suction process and a discharge process of the first compression device 110 have a phase difference of about 180° with respect to those of the second compression device 120. The first eccentric portion 107 and the second eccentric portion 108 may each have a size, i.e., widths and heights, that allow them to be housed within a first cylinder 111 and a second cylinder 121, respectively. At least one of the first and second eccentric portions 107 and 108 may include a balance hole 107*a* and 108*a* for reducing a weight thereof.

The first compression device 110 and the second compression device 120 may be laminated, positioning the middle plate 130 therebetween, in the order of the first compression device 110, the middle plate 130 and the second compression device 120, beginning at the lower end. Alternatively, they may be laminated in the order of the second compression device 120, the middle plate 130 and the first compression device 110.

The first compression device 110 may include the first cylinder 111 having a first compression space V1, the first rolling piston 112 that orbits in the first cylinder 111 and is rotatably coupled to the first eccentric portion 107, a first vane 113 coupled to the first cylinder 111 so as to be linearly movable and contact an outer circumferential surface of the first rolling piston 112, and a first vane spring 114 that elastically supports a rear end of the first vane 113.

A height H1 of the first cylinder 111 may be substantially the same as a height H2 of the second cylinder 121. Further, as the refrigerant suction pipe 11 is connected to the middle plate 130 and the connection pipe 14 is connected to the second cylinder 121, the height H1 of the first cylinder 111 may be less than the height H2 of the second cylinder 121.

The first cylinder 111 may include a suction port 115 formed at one edge of its inner circumferential surface to be connected to the refrigerant suction pipe 11, a first vane slot 116 formed at one side of the suction port 115 in a circumferential direction such that the first vane 113 may slide therein, and a first discharge guide groove formed at another side of the first vane slot 116 so as to be connected to a first outlet 141.

The second compression device 120 may include the second cylinder 121 having a second compression space V2, the second rolling piston 122 that orbits in the second cylinder 121 and is rotatably coupled to the second eccentric portion 108, a second vane 123 coupled to the second cylinder 121 so as to be linearly movable and selectively contact an outer circumferential surface of the second rolling piston 122, and a second vane spring 124 that elastically supports a rear end of the second vane 123.

The second cylinder 121 may include a second inlet 125 formed at one side thereof to be connected to the first cylinder 111 via the connection pipe 14, a second vane slot 126 formed at one side of the second inlet 125 such that the second vane 123 may slide therein, and a second discharge guide groove formed at another side of the second vane slot 126 to be connected to a second outlet 151.

The middle plate 130 may have a ring shape, and include a first inlet 131 formed at one side of its outer circumferential surface so as to be connected to the refrigerant suction pipe 11. The first inlet 131 may be recessed from an outer circumferential surface of the middle plate 130 by a predetermined depth. A communication hole 132 may be formed at a middle portion of the first inlet 131, or at an inner end of the first inlet 131 in an axial direction, or at an inclination angle so as to communicate with the suction port 115 of the first cylinder 111. Therefore, the middle plate 130 may be formed such that the first inlet 131 has a diameter long enough to communicate with the refrigerant suction pipe 11. The middle plate 130 may have a predetermined thickness in the vicinity of the first inlet 131 so as to ensure reliability thereof.

Irrespective of the order of laminating the first and second compression devices 110 and 120, a lower bearing 140 and an upper bearing 150 may be installed at lower and upper ends of the laminated compression devices so as to support the crankshaft 105 in an axial direction and simultaneously define the first and second compression spaces V1 and V2, respectively, together with the cylinders 111 and 121.

The lower bearing 140 may include the first outlet 141 formed at one side thereof such that refrigerant that has undergone first-stage compression in the first cylinder 111 is discharged therethrough, and a first discharge valve 142 installed at an end of the first outlet 141. A storage space 143 may be formed at one side surface of the lower bearing 140, namely, at a surface opposite the bearing surface. The storage space 143 may be covered with a cover plate 144 coupled to the lower bearing 140. A communication hole 145 may be formed at one side of the storage space 143 to allow a refrigerant discharged into the storage space 143 to be introduced into the second cylinder 121 via the connection pipe 14.

The upper bearing 150 may include the second outlet 151 formed at one side thereof to discharge refrigerant that has undergone second-stage compression in the second cylinder 121 therethrough, and a second discharge valve 152 installed at an end of the second outlet 151. A muffler 153 for housing the second discharge valve 152 may be installed at one side surface of the upper bearing 150, for example, at a surface opposite the bearing surface.

Operation of a twin rotary compressor as embodied and broadly described herein will now be discussed.

When the rotor 104 rotates in response to power supplied to the stator 103 of the driving motor 102, the crankshaft 105 rotates together with the rotor 103 so as to transfer a rotating force of the driving motor 102 to both the first and second compression devices 110 and 120. The first rolling piston 112 and the first vane 113 and the second rolling piston 122 and the second vane 123, which are respectively disposed in the first and second compression devices 110 and 120, perform an eccentric rotation in the first compression space V1 and the second compression space V2, respectively, thereby compressing refrigerant with a phase difference of approximately 180° therebetween.

For instance, when a suction process is initiated in the first compression space V1, refrigerant is introduced into the first compression space V1 of the first cylinder 111 sequentially through the accumulator 6, the refrigerant suction pipe 11, the first inlet 131 and the communication hole 132 of the middle plate 130 and the suction port 115 of the first cylinder 111, thereby undergoing first-stage compression. The first-stage compressed refrigerant is then discharged into the storage space 143 of the lower bearing 140 via the first outlet 141.

During the compression process in the first compression space V1, a suction process is initiated in the second compression space V2, which has a phase difference of approximately 180° from the first compression space V1. Accordingly, the refrigerant, which has been first-stage compressed in the first cylinder 111 and discharged into the storage space 143 of the lower bearing 140 is introduced into the second compression space V2 of the second cylinder 121 via the connection pipe 14. The refrigerant introduced in the second compression space V2 is then second-stage compressed in the second compression space V2 of the second cylinder 120, and discharged into the inner space of the hermetic casing 101 via the second outlet 151 and the muffler 153, thereby being discharged into the refrigeration cycle via the refrigerant discharge pipe 12. This series of processes may be repeated.

As the refrigerant suction pipe 11 is connected to the middle plate 130, the refrigerant suction pipe 11 does not necessarily have to be connected directly to the first cylinder 111, so the height H1 of the first cylinder 111 may be reduced. Consequently, a contact area between the first rolling piston 112 and the first vane 113 may be reduced, which allows reduction of refrigerant leakage from the first compression space V1, and improves performance of the compressor.

Referring to FIGS. 2 and 3, the connection pipe 14 may have one end connected to the communication hole 145 of the lower bearing 140 through the hermetic casing 101, and another end inserted in the second inlet 125 of the second cylinder 121 through the hermetic casing 101. A diameter of the connection pipe 14 may be less than a diameter of the refrigerant suction pipe 11.

Figure 4:
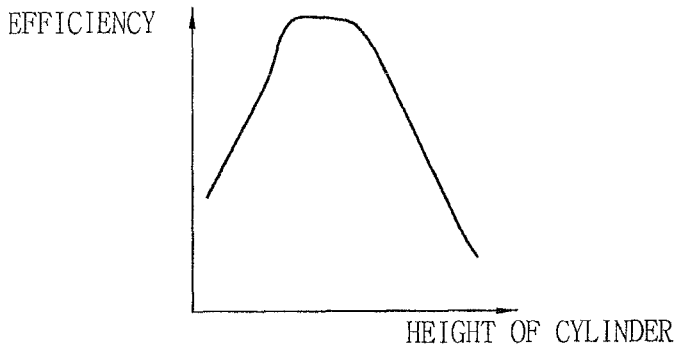
FIG. 4 is a graph of compressor efficiency with respect to a height of a cylinder of the two-stage rotary compressor shown in FIG. 2.
Figure 5:
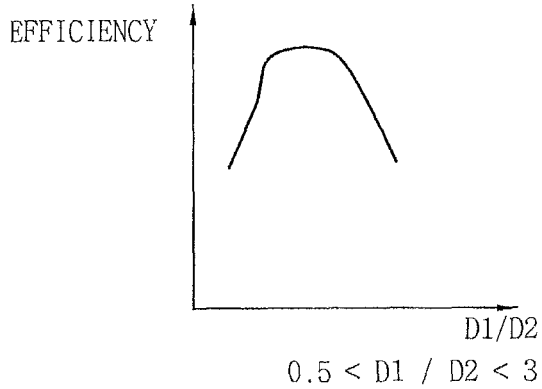
FIG. 5 is a graph of compressor efficiency with respect to a ratio of a refrigerant suction pipe to a connection pipe in the two-stage rotary compressor shown in FIG. 2.

For example, to enhance performance of the compressor, the connection pipe 14 may have a diameter D1 greater than 0.5 times a diameter D2 of the refrigerant suction pipe 11 and less than 0.3 times thereof. As shown in FIGS. 4 and 5, if the diameter D1 of the connection pipe 14 is less than or equal to 0.5 times of the diameter D2 of the refrigerant suction pipe 11, the refrigerant, which is first-stage compressed in the first compression space V1 to be discharged into the storage space 143, may not flow fast enough toward the second compression space V2 due to flow resistance, thereby lowering performance of the compressor. On the other hand, if the diameter D1 of the connection pipe 14 greater than or equal to 3.0 times the diameter D2 of the refrigerant suction pipe 11, the diameter of the connection pipe 14 also increases that much. Accordingly, the height H2 of the second cylinder 121 drastically increases, causing further refrigerant leakage between the second rolling piston 122 and the second vane 123, and lowering performance of the compressor.

This embodiment illustrates that the height of the first cylinder 111 may be less than the height of the second cylinder 121. Alternatively, the first and second cylinders 111 and 121 may have substantially the same height. In this case, the diameter of the connection pipe 14 may less than the diameter D2 of the refrigerant suction pipe 11, so as to enhance performance of the compressor.

Figure 6:
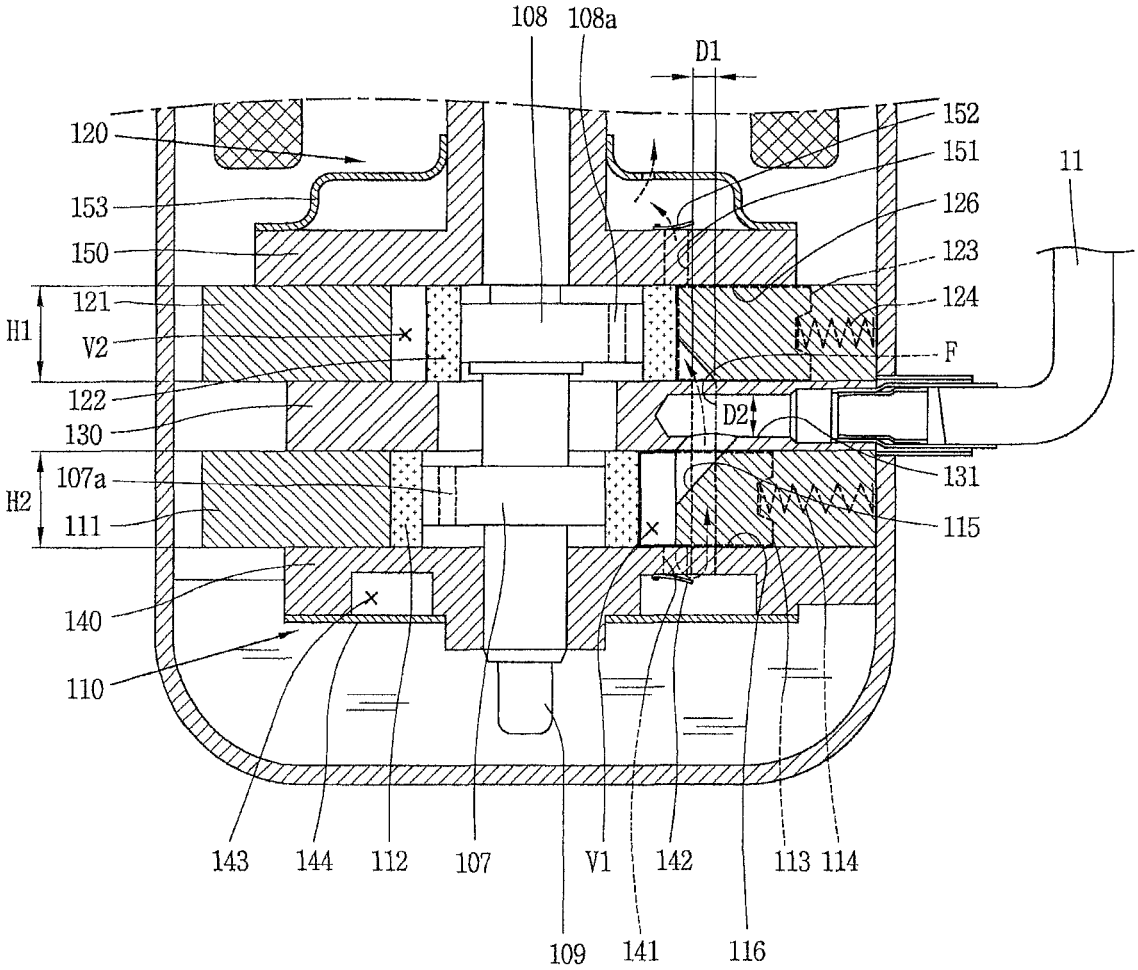
FIG. 6 is a longitudinal sectional view of another embodiment of a two-stage rotary compressor as broadly described herein.

The first and second cylinders 111 and 121, as aforesaid, may be connected to each other via the connection pipe 14, and the connection pipe 14 may be connected thereto via the outside of the hermetic casing 101. Alternatively, as shown in FIG. 6, the first and second cylinders 111 and 121 may communicate with each other via an internal passage F, which sequentially penetrates through the lower bearing 140, the first cylinder 111, the middle plate 130 and the second cylinder 121, causing a refrigerant discharged into the storage space 143 to flow into the second compression space V2. In these cases, the injection pipe 13 may be connected to the connection pipe 14 or the internal passage F, and the compression efficiency of the compressor may be enhanced. Also, even in this case, a diameter of the internal passage F may be greater than 0.5 times the diameter D2 of the refrigerant suction pipe 11 and less than 0.3 times thereof.

A twin rotary compressor is provided that is capable of enhancing efficiency of the compressor by decreasing a refrigerant leakage out of a cylinder in view of reducing a height of the cylinder.

A twin rotary compressor as embodied and broadly described herein may include a hermetic casing, a crankshaft installed in the hermetic casing and having first and second eccentric portions, a first cylinder installed in the hermetic casing and having a first rolling piston coupled to the first eccentric portion, a second cylinder installed in the hermetic casing and having a second rolling piston coupled to the second eccentric portion, an upper bearing and a lower bearing installed at one side surfaces of the first cylinder and the second cylinder, respectively, to define a first compression space and a second compression space, and a middle plate interposing between the first cylinder and the second cylinder and configured to partition the first compression space of the first cylinder and the second compression space of the second cylinder, wherein the middle plate comprises an inlet connected with a refrigerant suction pipe, the inlet is communicated with the first compression space of the first cylinder, an outlet of the first compression space of the first cylinder is connected to the second compression space of the second cylinder, and an outlet of the second compression space of the second cylinder is communicated with an inner space of the hermetic casing.

In a twin rotary compressor as embodied and broadly described herein, as a refrigerant suction pipe is connected to a middle plate interposed between a first cylinder and a second cylinder to thus reduce a height of the first cylinder, heights of a first rolling piston and a first vane can be lowered, which allows a contact area between the first rolling piston and the first vane to be decreased so as to reduce a refrigerant leakage from a first compression space of the first cylinder, resulting in improvement of compression efficiency of the compressor.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A twin rotary compressor, comprising:

a hermetic casing;

a crankshaft installed in the hermetic casing and having first and second eccentric portions eccentrically protruding from an axial center of the crankshaft in opposite direction to each other;

a first cylinder installed in the hermetic casing and having a first rolling piston thereof coupled to the first eccentric portion, and configured to perform first-stage compression of refrigerant;

a second cylinder installed in the hermetic casing and having a second rolling piston thereof coupled to the second eccentric portion, and configured to receive refrigerant that has undergone first-stage compression in the first cylinder and to perform second-stage compression of the received refrigerant;

a middle plate positioned between the first and second cylinders;

an upper bearing and a lower bearing installed at respective outer sides of the first cylinder and the second cylinder so as to define a first compression space and a second compression space in the first and second cylinders together with the middle plate; and a communication passage connected between an outlet side of the first compression space and an inlet side of the second compression space, wherein the middle plate comprises an inlet connected to a refrigerant suction pipe, and a communication hole formed at a middle portion of the inlet toward the first cylinder, wherein the first cylinder comprises a first suction hole connected to the communication hole of middle plate, wherein the lower bearing comprises a first discharge hole connected to one end of the communication passage so as to discharge the first-stage compressed refrigerant toward the second compression space, wherein the second cylinder comprises a second suction hole connected to another end of the communication passage so as to guide the first-stage compressed refrigerant to be introduced into the second compression space, wherein the upper bearing comprises a second discharge hole connected to an inner space of the hermitic casing so as to guide the second-stage compressed refrigerant into the inner space of the hermitic casing, and wherein a height of the first cylinder is equal to a height of the second cylinder.

2. The twin rotary compressor of claim 1, wherein a height of the first eccentric portion is equal to a height of the second eccentric portion, and wherein at least one of the first eccentric portion or the second eccentric portion comprises a balance hole that reduces a weight thereof, the balance hole formed through the at least one eccentric portion in an axial direction.

3. The twin rotary compressor of claim 1, further comprising a connection pipe that extends outside of the hermetic casing so as to guide refrigerant that has undergone a first-stage compression in the first compression space of the first cylinder into the second compression space of the second cylinder.

4. The twin rotary compressor of claim 3, further comprising a storage space formed at an outlet side of the first cylinder so as to define an intermediate pressure chamber, wherein a first end of the connection pipe is connected to the storage space and a second end thereof is connected to a second inlet of the second cylinder.

5. The twin rotary compressor of claim 4, wherein the storage space comprises a groove formed in a side surface of the lower bearing and a cover plate coupled to the lower bearing so as to cover the groove.

6. The twin rotary compressor of claim 1, wherein an internal passage is sequentially formed through the first cylinder, the middle plate and the second cylinder to guide refrigerant that has undergone first-stage compression in the first compression space of the first cylinder into the second compression space of the second cylinder.

7. The twin rotary compressor of claim 6, further comprising a storage space formed at an outlet side of the first cylinder so as to define an intermediate pressure chamber, wherein a first end of the internal passage communicates with the storage space and a second end of the internal passage communicates with the second compression space of the second cylinder.

8. The twin rotary compressor of claim 1, wherein a diameter of a refrigerant passage is greater than 0.5 times a diameter of the refrigerant suction pipe and less than 3.0 times thereof.

9. A twin rotary compressor, comprising:

a hermetic casing;

a crankshaft installed in the hermetic casing and having first and second eccentric portions eccentrically protruding from an axial center of the crankshaft in opposite direction to each other;

a first cylinder installed in the hermetic casing and having a first rolling piston thereof coupled to the first eccentric portion and a first vane that contacts an outer circumferential surface of the first rolling piston, and configured to perform first-stage compression refrigerant;

a second cylinder installed in the hermetic casing and having a second rolling piston thereof coupled to the second eccentric portion and a second vane that contacts an outer circumferential surface of the second rolling piston, and configured to receive refrigerant that has undergone first-stage compression in the first cylinder and perform second-stage compression of the received refrigerant;

a middle plate positioned between the first and second cylinders; and an upper bearing and a lower bearing installed at respective outer sides of the first cylinder and the second cylinder so as to define a first compression space and a second compression space together with the middle plate, wherein the middle plate comprises an inlet connected to a refrigerant suction pipe, the inlet being in communication with the first compression space of the first cylinder, with a storage space formed at an outlet side of the first cylinder so as to define an intermediate pressure chamber that is connected to the second compression space of the second cylinder, and an outlet of the second compression space of the second cylinder in communication with an inner space of the hermetic casing, a communication passage connected between an outlet side of the storage space and an inlet side of the second compression space, wherein the middle plate comprises an inlet connected to a refrigerant suction pipe, and a communication hole formed at a middle portion of the inlet toward the first cylinder, wherein the first cylinder comprises a first suction hole connected to the communication hole of the middle plate, wherein the bearing comprises a first discharge hole connected to one end of the storage space so as to discharge the first-stage compressed refrigerant into the storage space, wherein the second cylinder comprises a second suction hole connected to another end of the communication passage so as to guide the first-stage compressed refrigerant to be introduced into the second compression space, wherein the upper bearing comprises a second discharge hole connected to an inner space of the hermitic casing so as to guide the second stage compressed refrigerant into the inner space of the hermitic casing, wherein a height of the first cylinder is equal to a height of the second cylinder, and wherein the height of the first rolling piston and the first vane is equal to the height of the second rolling piston and the second vane.

10. The twin rotary compressor of claim 9, wherein a height of the first eccentric portion is equal to a height of the second eccentric portion.

11. The twin rotary compressor of claim 9, wherein at least one of the first eccentric portion or the second eccentric portion comprises a balance hole that reduces a weight thereof, the balance hole formed through the at least one eccentric portion in an axial direction.

12. The twin rotary compressor of claim 9, further comprising a connection pipe that extends outside of the hermetic casing so as to guide refrigerant that has undergone first-stage compression in the first compression space of the first cylinder into the second compression space of the second cylinder.

13. The twin rotary compressor of claim 12, wherein a first end of the connection pipe is connected to the storage space and a second end thereof is connected to a second inlet of the second cylinder.

14. The twin rotary compressor of claim 9, wherein the storage space comprises a groove formed in a side surface of the lower bearing and a cover plate coupled to the lower bearing so as to cover the groove.

15. The twin rotary compressor of claim 9, further comprising an internal passage sequentially formed through the first cylinder, the middle plate and the second cylinder so as to guide refrigerant that has undergone first-stage compression in the first compression space of the first cylinder into the second compression space of the second cylinder.

16. The twin rotary compressor of claim 15, wherein a first end of the internal passage communicates with the storage space and a second end of the internal passage communicates with the second compression space of the second cylinder.

17. The twin rotary compressor of claim 9, wherein a diameter of a refrigerant passage is greater than 0.5 times a diameter of the refrigerant suction pipe and less than 3.0 times thereof.

* * * * *